United States Patent [19]

Goodwin

[11] Patent Number: 4,915,053

[45] Date of Patent: Apr. 10, 1990

[54] METHOD AND APPARATUS FOR CATHODIC PROTECTION OF MARINE VESSELS

[76] Inventor: Wendell Goodwin, 9632 Remer St., South El Monte, Calif. 91733

[21] Appl. No.: 242,155

[22] Filed: Sep. 9, 1988

[51] Int. Cl.[4] ..... B63B 17/00

[52] U.S. Cl. ..... 114/343; 204/196; 114/221 R

[58] Field of Search ..... 204/196, 197, 147, 148; 114/221 R, 343, 270; 440/113; 248/300, 544

[56] References Cited

U.S. PATENT DOCUMENTS

| | | | |
|---|---|---|---|
| 2,779,729 | 1/1967 | Jorgensen | 204/197 |
| 2,904,489 | 9/1959 | Sabins | 204/197 |
| 3,001,924 | 9/1961 | Battis et al. | 204/197 |
| 3,152,059 | 10/1964 | Wellington | 204/196 |
| 3,232,857 | 2/1966 | Caldwell | 204/197 |
| 3,385,254 | 5/1968 | Goldberg et al. | 204/196 |
| 3,410,772 | 11/1968 | Geld et al. | 204/196 |
| 3,412,005 | 11/1968 | Beer et al. | 204/196 |
| 3,657,084 | 4/1972 | Beer et al. | 204/196 |
| 3,718,570 | 2/1973 | Geld | 204/196 |
| 3,791,709 | 2/1974 | Cross | 248/300 |
| 4,143,843 | 3/1979 | Ehrens et al. | 248/544 |
| 4,325,798 | 3/1983 | Mack | 204/197 |
| 4,467,486 | 8/1984 | Schatz | 248/300 |
| 4,549,949 | 10/1985 | Guinn | 204/196 |
| 4,604,068 | 8/1986 | Guinn | 440/76 |

FOREIGN PATENT DOCUMENTS

| | | | |
|---|---|---|---|
| 960304 | 6/1964 | United Kingdom | 204/197 |
| 980860 | 1/1965 | United Kingdom | 204/197 |

*Primary Examiner*—Joseph F. Peters, Jr.
*Assistant Examiner*—Edwin L. Swinehart

[57] ABSTRACT

An improved sacrificial marine anode is adapted for installation on numerous different types of marine vessels. The anode is comprised of a plate of sacrificial metal formed with a pair of longitudinally aligned slots which are spatially separated from each other and which are defined entirely within the perimeter of the plate. The anode may be installed on a marine vessel having a hull and a pair of spatially separated studs projecting from the hull below the waterline thereof. The anode is installed by placing the slab against the hull from beneath the waterline such that the studs project through the slots, and securing fasteners to the ends of the studs to clamp the slab against the hull.

10 Claims, 1 Drawing Sheet

FIG. 1
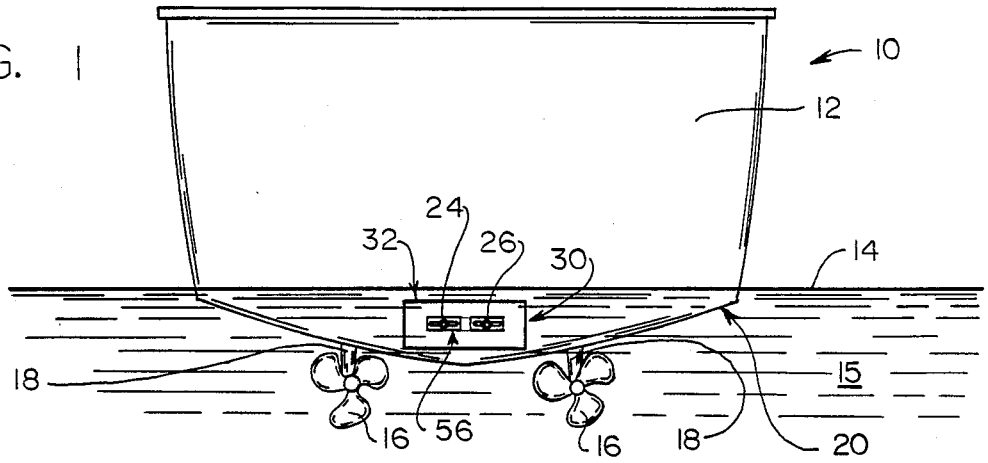
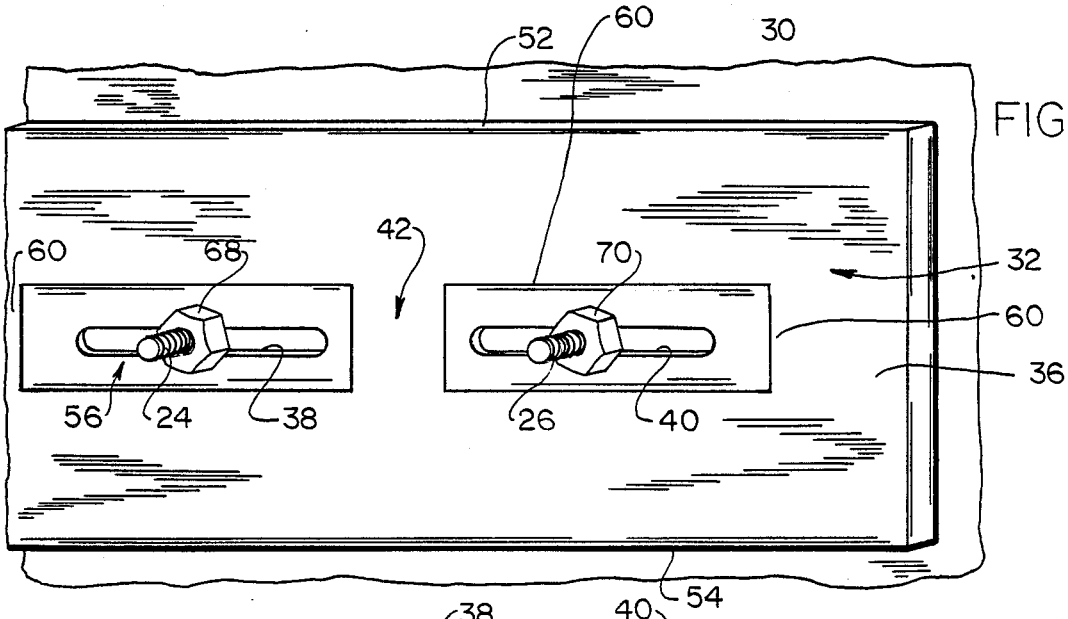
FIG. 2
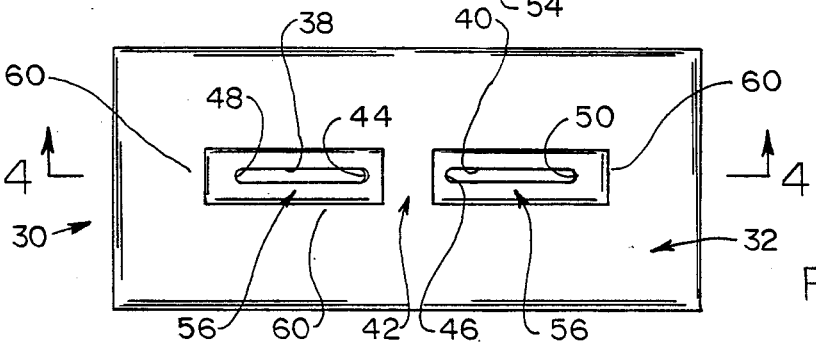
FIG. 3
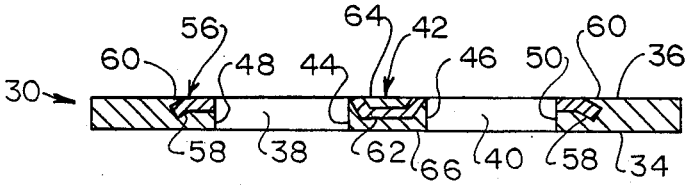
FIG. 4

METHOD AND APPARATUS FOR CATHODIC PROTECTION OF MARINE VESSELS

BACKGROUND OF THE INVENTION

1. Field of the Invention

The present invention relates to a method and apparatus for providing anodic protection for submerged metal structures on marine vessels.

2. Description of the Prior Art

It is a well known fact that submerged metallic structures on marine vessels are susceptible to attack and disintegration by salt water. The hulls of most pleasure marine craft which are currently being manufactured are constructed of fiberglass embedded in polyester or epoxy resin. In earlier years the hulls of marine vessels were typically constructed of wood. While neither fiberglass nor wood are electrolytically attacked by salt water, virtually all marine vessels require various fittings and drive components which must be formed of metal for strength and which are always submerged when the vessel is in the water. For example, any boat having an inboard engine must necessarily have a propeller shaft extending through a sealed drive shaft opening and a propeller mounted upon the shaft. Also, the propeller shaft must be stabilized by a metal propeller shaft supporting strut. In addition to drive components, virtually all marine vessels have numerous through-holes for cooling water intakes and exhausts, bilge pump outlets, flushing water intakes, and the like. All such through-holes are conventionally lined with annular metal fittings to provide rigidly at points which would otherwise be structurally weak openings in the hull.

All metal fittings and drive components which are maintained in a submerged condition on the underside of a hull of a marine vessel are formed of those metals which are the least susceptible to the strong electrolytic action created by the presence of brine in seawater. Such fittings and drive components are typically constructed of brass, bronze, or silicone bronze. However, although electrolytic destruction of these metals is quite slow, even these metals will deteriorate and disintegrate when maintained in a submerged condition over a prolonged period of time.

To prevent the destruction of vital hull fittings and drive components, sacrificial anodes have long been employed in the vicinity of the metal fittings and drive components on the undersides of the hulls of marine vessels. Sacrificial anodes are formed of metals which have far greater susceptibility to electrolytic action than do the metals forming the hull fittings and drive components. Consequently, electrolytic attack at the underside of the hull operates primarily against the sacrificial anode, rather than the hull fittings and drive components. When the sacrificial anode has been largely destroyed by electrolytic attack, it is merely replaced. The structural integrity of the metal hull fittings and drive components is thereby preserved.

Conventional sacrificial anodes designed for use of marine vessels typically are constructed as slabs or plates, usually about one half inch in thickness, about six inches in width and about twelve inches in length. In the initial fabrication of marine vessels at least one pair of parallel, threaded studs are normally embedded in the hull to project externally therefrom below the waterline of the vessel. The studs are used to mount the slab-like or plate-like sacrificial anodes.

In conventional practice, sacrificial anodes are normally replaced by a diver operating submerged below the surface of the water. Replacement is typically performed as an incidental service in conjunction with cleaning marine growth from the underside of the hull. The hulls of most marine vessels need to be cleaned of marine growth, typically every two to four weeks. The diver who cleans the hull of a marine vessel normally checks the condition of the sacrificial anode at the time the hull cleaning operation is performed. If the anode has suffered significant electrolytic attack, it must be replaced.

When a diver recognizes that an anode requires replacement, the conventional procedure is to first measure the diameter and spacing of the studs adapted to hold the sacrificial anode in position. The diver thereby creates a pattern while beneath the surface of the water on a first occasion. After leaving the water on that first occasion the diver takes the pattern to his workshop and drills holes in a replacement sacrificial anode of a size and spacing according to the pattern. While most pleasure craft currently being manufactured employ anode mounting studs which are three-eights of an inch in diameter, the spacing between these studs varies considerably between boat manufacturers, models of boats constructed by the same manufacturer, and even among different boats of the same model.

When anode mounting studs are embedded in the hull of the craft during fabrication of the hull, they are normally spaced in pairs, with the spacing of the studs within each pair varying from between about two to about six inches, center-to-center. However, because there is such a wide variance in center-to-center spacing among individual vessels within this range, it is impractical for sacrificial anodes to be predrilled and installed while cleaning the hull on the first occasion of entry into the water by the diver. This would require stocking an excessive number of sacrificial anodes having a wide variety of different mounting aperture spacings. Moreover, the diver does not know the size and spacing of the anode mounting studs until he can actually take these measurements on the first occasion of entry into the water. Consequently, the replacement of a sacrificial anode currently requires two dives for each replacement effort, and drilling of holes in a new sacrificial anode between these dives.

The present practice in replacing sacrificial anodes is quite time consuming and wasteful. A great deal of the time of replacement is expended by a diver in suiting up and reentering the water in the vicinity of a vessel which has already had its hull cleaned. Also, the diver must expend further time in traveling to the vessel for the second dive.

SUMMARY OF THE INVENTION

One principal object of the present invention is to provide a system for sacrificial anode replacement which allows a diver to replace an anode in a single dive. According to the system of the invention a sacrificial anode can be replaced as an incident to cleaning the submerged portion of a hull of a vessel in a single dive. No time is expended in returning to the vessel for a second dive, and no time is expended in drilling hulls in a replacement sacrificial anode.

Another object of the present invention is to provide a sacrificial anode which has almost universal adaptability for use in cathodic protection of marine pleasure craft. Indeed, a sacrificial anode constructed according to the invention can be utilized with about ninety to ninety five percent of the marine power pleasure craft currently being manufactured.

A further object of the invention is to provide an improved sacrificial anode which will remain securely in position longer than conventional sacrificial anodes. Conventional sacrificial anodes are typically zinc plates drilled with a pair of apertures through which the mounting studs project when the anode is mounted upon the submerged portion of the hull. Silicone bronze nuts are threadably engaged on the ends of the studs to hold the anodes against the hull.

Often, however, electrolytic degradation of the sacrificial anode will be greatest at the locations where the anodes are drilled to receive the mounting studs. The apertures then increase in size relatively rapidly until the structure of the anode no longer provides a bearing surface by means of which the anodes can be clamped by the fastening nuts against the hull of the vessel. Thus, although a sacrificial anode may be only partially degraded when considered in its entirety, degradation occurs at the locations at which is it fastened to the hull of the vessel. The sacrificial anode will thereupon often fall off, even though it has served its intended purpose for only a relatively small portion of its useful life. Premature replacement of the anode is thereupon necessary.

To solve this problem the improved anode of the invention is provided with a bearing core formed of a material that is anodically less active than the slab or plate which forms the bulk of the anode. A core is embedded in the electrolytically more vulnerable slab plate in such a manner as to hold the slab in position against the hull of the vessel for the duration of its useful life.

In one broad aspect the present invention is an improved anodic protective device for marine installation comprising a flat slab formed of a sacrificial anode and defining entirely within its periphery at least a pair of separate longitudinally aligned, elongated slots. These slots are of a length and spacing which will accommodate the vast majority of anode mounting studs in marine power pleasure craft currently being manufactured.

While the spacing of anode mounting studs in different pleasure craft varies considerably, the studs themselves are often three-eighths of an inch in diameter. Accordingly, in a preferred embodiment of the invention the slots defined within the slab are both about seven-sixteenths of an inch in width and are of a uniform width throughout. Preferably also, the slots have ends located proximate to each other which are spatially separated from each other by a distance of at least two inches. These slots preferably also have ends located remote from each other and which are spatially separated from each other by a distance of about six and three-quarter inches. Since most of the anode mounting studs in the vast majority of marine power pleasure craft extend outwardly parallel to each other at a distance of about two and one-half inches up to about six inches, the improved anodic protective device of the invention has almost universal application among such vessels.

In a preferred embodiment of the invention the slab of the anode has an inner surface for facing the hull of a marine vessel and an opposite outer surface. Also, the anode is further comprised of a bearing core formed of a material anodically less active than the slab embedded in the slab to surround the slots. The bearing core is exposed at the outer surface of the slab to completely surround the slots, so that the fastening nuts which hold the anodic protective device against the hull of the vessel contact and bear against the structure of the bearing core, rather than against the structure of the more vulnerable slab. The anodic protective device will therefore not deteriorate rapidly at the interface between the fastening nuts and the bearing core, and will therefore remain in position throughout the useful life of the anode.

Preferably also the structure of the slab overhangs portions of the core at the outer surface to secure the core to the slab and to prevent the slab from separating from the core. In this preferred embodiment the slab is preferably formed of zinc while the bearing core is constructed of galvanized steel.

In another broad aspect the present invention may be considered to be an improved method of providing anodic protection for a marine vessel having a hull and a pair of spatially separated studs projecting from the hull below the waterline thereof. The improvement of the method is comprised of installing a flat slab formed of a sacrificial metal within the perimeter of which are defined a pair of separate longitudinally aligned elongated slots. This installation is performed by placing the slab against the hull of the vessel from beneath the waterline such that the studs project through the slots. Fasteners are secured to the ends of the studs to clamp the slab against the hull. The slab is positioned such that a separate one of the studs projects through each one of the slots.

Unlike prior procedures for providing anodic protection, the method of the present invention may be performed in a single dive using a protective anode of almost universal application. The diver therefore needs to merely take with him a single sacrificial anode, constructed according to the invention, to a vessel to be cleaned. If, in checking the condition of the existing sacrificial anode, the diver determines that replacement is necessary, the replacement process can be performed immediately without leaving the site of the vessel, and without the necessity for creating patterns or drilling holes. Thus, the diver accomplishes anode replacement in a mere fraction of the time that has heretofore been necessary.

The invention may be described with greater clarity and particularity by reference to the accompanying drawings.

DESCRIPTION OF THE DRAWINGS

FIG. 1 is a rear elevational view showing the transom of a marine vessel with an improved anode according to the invention installed thereon.

FIG. 2 is a perspective detail of the anode illustrated in FIG. 1 showing the manner of installation thereon.

FIG. 3 is an elevational detail showing the anode of FIG. 1 in isolation.

FIG. 4 is a sectional view taken along the lines 4—4 of FIG. 3.

DESCRIPTION OF THE EMBODIMENT AND IMPLEMENTATION OF THE METHOD

FIG. 1 illustrates a marine vessel 10 having a transom 12, a portion of which extends below the waterline 14 of seawater 15 in which the vessel 10 floats. As in other conventional marine vessels, propellers 16 and propeller shaft stabilizing struts 18 project downwardly from the submerged portion of the hull 20 of the marine vessel 10 and are exposed to the destructive electrolytic action of the seawater 15.

As best illustrated in FIG. 2, a pair of externally threaded brass or bronze studs 24 and 26 are permanently embedded in the structure of the hull 20 and project outwardly therefrom below the waterline 14 parallel to each other and at a center-to-center distance of between about two and one-half and six inches. Like most conventional anode mounting studs, the studs 24 and 26 are three-eighths of an inch in diameter.

To protect the propellers 16 and the propeller shaft stabilizing struts 18 from destructive electrolysis, an improved anode 30 of the invention is mounted on the anode mounting studs 24 and 26. The improved anode 30 is comprised of a flat zinc plate 32. The plate 32 is one-half inch in thickness between its inner surface 34 which is adapted for positioning against the hull 20 of the marine vessel 10, and its opposite outer surface 36. The plate 32 is of a rectangular configuration about six inches in width between opposite longitudinal edges 52 and 54 and about twelve inches in length.

The plate 32 is formed with a pair of longitudinally aligned, oblong slots 38 and 40 which are spatially separated from each other by a web, indicated at 42. The slots 38 and 40 have ends 44 and 46, respectively, which are located proximate to each other and which are separated from each other by the web 42, and opposite, mutually remote ends 48 and 50, respectively. The slots 38 and 40 are linearly aligned longitudinally within the plate 32, equidistant from the opposite longitudinal edges 52 and 54, which are located about six inches apart. The web 42 creates a spatial separation between the proximate slot ends 44 and 46 of at least two inches. The opposite remote ends 48 and 50 of the slots 38 and 40 terminate about six and three-quarter inches apart from each other. The slots 38 and 40 are both of a uniform width of about seven-sixteenths of an inch.

The anode 30 is also comprised of a core 56 which may be between about three-sixteenths and one-quarter of an inch in thickness. The core 56 is preferably about eight inches long and about one and one-quarter inches in width and is embedded in the plate 32 to completely surround the edges of the slots 38 and 40 at the outer surface 36 of the plate 32. The core 56 is fabricated from a material that is less anodic than the plate 32. Preferably, the core 56 is fabricated of galvanized steel.

As illustrated in FIG. 4, the peripheral, marginal edges 58 of the core 56 are turned downwardly, away from the outer surface 36 and toward the other surface 34. The structure of the plate 32 forms overhanging lips 60 which capture the peripheral marginal edges 58 of the core 56. Also, the interior portion 62 of the core 56 at the web 42 is entrapped within the web 42. The interior core portion 56 is entrapped by a layer 64 of the structure of the plate 32 at the outer surface 36 and by a layer 66 of the structure of the plate 32 at the inner surface 34 of the plate 32. The interlocking engagement of the core 56 and the plate 32 firmly holds the core 56 and plate 32 together as an inseparable unit.

To install the improved anode 30 of the invention, a diver unloosens the silicone bronze anode mounting nuts 68 and 70 from the studs 24 and 26, respectively. Any remaining structure of a degraded anode to be replaced is dislodged from the studs 24 and 32 and from the surrounding area of the hull 20. The improved anode 30 is then placed in position with the surface 34 thereof flush against the hull 20 so that the stud 24 projects through the slot 38 and the stud 26 projects through the slot 40. Because the slots 38 and 40 are linearly aligned and are each about two and three-eighths inches in length, the anode 30 of the invention can easily accommodate the studs 24 and 26, which may be variably spaced anywhere from about two and one-half apart up to about six inches apart, center-to-center.

Once the anode 30 has been mounted against the hull 20, the anode mounting nuts 68 and 70 are retightened onto the studs 24 and 26, respectively. It should be noted that the mounting nuts 68 and 70 bear directly against the structure of the core 56, not against the structure of the more electrolytically vulnerable plate 32. As a consequence, a good bearing interface is maintained between the retaining nuts 68 and 70 and the juxtaposed surfaces of the core 56 against which the nuts 68 and 70 bear. The core 56 will not deteriorate nearly as rapidly as the structure of the sacrificial anode plate 32. As a consequence, the anode 30 will remain firmly secured against the hull 20 of the vessel 10 throughout its useful life.

It should be noted that removal of the old anode and installation of the improved anode 30 of the invention are accomplished in just a few moments time during a single diving operation in the vicinity of the hull 20 of the vessel 10. The diver can thus complete the anode installation incident to cleaning marine growth from the hull 20 in a single dive, and carrying with him but a single, universally adaptable anode 30. Moreover, the diver does not need to be concerned with creating any pattern or drilling any holes in the anode 30, since the configuration of the slots 38 and 40 allows it to be installed on the vast majority of power pleasure crafts currently being produced.

Undoubtedly, numerous variations and modifications of the anode of the invention, and numerous variations and modifications of the implementation of the method of the invention will become readily apparent to those familiar with cathodic protection of marine vessels. Accordingly, the scope of the invention should not be construed as limited to the specific embodiment and implementation of the method described herein, but rather is defined in the claims appended hereto.

I claim:

1. An improved anodic protection device for marine installation comprising a flat slab formed of a sacrificial metal and having an inner surface for facing the hull of a marine vessel and an opposite, outer surface, and defining entirely within its periphery at least a pair of separate, longitudinally aligned elongated slots having ends located proximate to each other and spatially separated from each other by a distance of at least two inches and having ends located remote from each other and separated by a distance no less than about six and three quarter inches, and a bearing core formed of a material anodically less active than said slab embedded in said slab and exposed at said outer surface of said slab so as to surround said slots.

2. An improved anodic protective device according to claim 1 wherein said slots are both about seven sixteenths of an inch in width.

3. An improved anodic protective device according to claim 1 wherein structure of said slab overhangs portions of said core at said outer surface to secure said core to said slab.

4. An improved anodic protective device according to claim 3 wherein said core is constructed of galvanized steel.

5. An anode according to claim 1 wherein said plate is constructed of zinc metal and said core is constructed of galvanized steel.

6. An improved anode for protecting a marine vessel comprising a plate of a sacrificial metal formed with a pair of longitudinally aligned slots which are spatially separated from each other and which are defined entirely within the perimeter of said plate and which have mutually proximate ends and separated from each other by at least two inches of structure of said plate, and which have mutually remote ends which terminate at a distance of at least about six and three quarter inches from each other, and a core fabricated from a material less anodic than said plate and embedded in said plate to completely surround said slots, and wherein said plate has an inner surface for positioning against the hull of a vessel and an opposite outer surface, and said core is exposed at said outer said surface of said plate so as to completely surround said slots.

7. An anode according to claim 6 wherein said slots have a uniform width of about seven sixteenths of an inch throughout.

8. An anode according to claim 6 in which said outer surface of said plate is formed with overhanging lips which are defined to capture the peripheral margin of said core.

9. In a method of providing anodic protection for a marine vessel having a hull and a pair of spatially separated studs projecting from said hull below the waterline thereof, the improvement comprising installing an anodic protection device including a flat slab having an inner surface for facing the hull of a marine vessel and an opposite outer surface, formed of a sacrificial metal, and defining entirely within its periphery at least a pair of separate, longitudinally aligned, elongated slots having mutually proximate ends spatially separated from each other by a distance of at least two inches and mutually remote ends spatially separated from each other by a distance of at least about six and three quarter inches, and a bearing core formed of a material anodically less active than said slab embedded in said slab and exposed at said outer surface of said slab so as to surround said slots, by placing said inner surface of said slab against said hull from beneath said waterline such that said studs project through said slots, and securing fasteners to the ends of said studs to bear against said core to thereby clamp said slab against said hull.

10. A method according to claim 9 further comprising positioning said slab so that a separate one of said studs projects through each of said slots.

* * * * *